United States Patent [19]

Weihrauch

[11] Patent Number: 4,979,782

[45] Date of Patent: Dec. 25, 1990

[54] PROCESS AND APPARATUS FOR PRODUCTION OF BRISTLE PRODUCTS

[75] Inventor: Georg Weihrauch, Wald-Michelbach, Fed. Rep. of Germany

[73] Assignee: Coronet-Werke Heinrich Schlerf GmbH, Fed. Rep. of Germany

[21] Appl. No.: 365,397

[22] Filed: Jun. 13, 1989

[51] Int. Cl.[5] ..... A46D 1/06

[52] U.S. Cl. ..... 300/4; 300/21

[58] Field of Search ..... 300/2–11, 300/21; 264/248, 243

[56] References Cited

U.S. PATENT DOCUMENTS

| | | | |
|---|---|---|---|
| Re. 27,455 | 8/1972 | Lewis, Jr. . | |
| 74,560 | 2/1868 | Maury . | |
| 105,373 | 7/1870 | Ruset . | |
| 392,420 | 11/1888 | Fish . | |
| 654,184 | 7/1900 | Schwartz . | |
| 764,898 | 7/1904 | Mumford | 300/2 |
| 803,995 | 11/1905 | Davenport . | |
| 958,371 | 5/1910 | Danek . | |
| 1,018,927 | 2/1912 | Sarrazin . | |
| 1,257,883 | 2/1918 | Kone . | |
| 1,360,615 | 11/1920 | Bolard . | |
| 1,382,681 | 6/1921 | Segal . | |
| 1,564,526 | 12/1925 | Callais . | |
| 1,901,646 | 3/1933 | Hicks . | |
| 1,923,884 | 8/1933 | Pushee . | |
| 2,035,709 | 3/1936 | Laub et al. . | |
| 2,066,068 | 12/1936 | Cooke . | |
| 2,097,987 | 11/1937 | Phillips . | |
| 2,224,788 | 12/1940 | Jobst . | |
| 2,227,126 | 12/1940 | Cooke . | |
| 2,303,800 | 12/1942 | Swann . | |
| 2,426,328 | 8/1947 | Wandel et al. . | |
| 2,488,873 | 11/1949 | Maynard . | |
| 2,587,792 | 3/1952 | Von Sivers . | |
| 2,643,158 | 6/1953 | Baldanza . | |
| 2,653,056 | 9/1953 | Montero et al. | 300/21 |
| 2,664,316 | 12/1953 | Winslow, Jr. et al. | 300/21 |
| 2,710,774 | 6/1955 | Baumgartner | 300/4 |
| 2,783,490 | 3/1957 | Kutik | 15/187 |
| 2,797,424 | 7/1957 | Olson | 15/167 |
| 3,219,742 | 11/1965 | Reinert | 264/248 |
| 3,408,112 | 10/1968 | Piotrowski | 300/21 |
| 3,471,202 | 10/1969 | Lewis, Jr. | 300/2 |
| 3,545,025 | 12/1970 | O'Connell | 15/104.94 |
| 3,563,609 | 2/1971 | Lewis, Jr. | 300/7 |
| 3,580,761 | 5/1971 | Boultinghouse | 156/72 |
| 3,596,999 | 8/1971 | Lewis, Jr. | 300/21 |
| 3,604,043 | 9/1971 | Lewis, Jr. . | |
| 3,633,974 | 1/1972 | Lewis, Jr. . | |
| 3,640,786 | 2/1972 | Carpenter . | |

(List continued on next page.)

FOREIGN PATENT DOCUMENTS

| | | |
|---|---|---|
| 0078569 | 5/1983 | European Pat. Off. . |
| 0086412 | 8/1983 | European Pat. Off. . |

(List continued on next page.)

OTHER PUBLICATIONS

Zahnaerztliche Mitteilungen, 1987, vol. 16, pp. 1740–1745.

Quintessence International, 1988, vol. 2, pp. 87–107.

*Primary Examiner*—Mark Rosenbaum

*Attorney, Agent, or Firm*—E. Kelly Linman; John V. Gorman; Richard C. Witte

[57] ABSTRACT

Process and apparatus for the production of bristle products from plastic. The products comprise a bristle carrier and bristles whose utilization-side ends are substantially unformly rounded and located in a contour differing from that of the bristle side surface of the bristle carrier. The opposite ends of the bristles are fastened to the bristle side surface of the bristle carrier. In a particularly preferred embodiment, the process comprises the steps of: clamping the bristles while their utilization-side ends are in a flat plane; substantially uniformly rounding the utilization-side ends of the bristles while they are clamped in the flat plane; loosening the clamp restraining the bristles and thereafter axially displacing the utilization-side ends of the bristles relative to one another to produce the desired contour; and fastening the opposite ends of the bristles to the bristle carrier.

26 Claims, 2 Drawing Sheets

U.S. PATENT DOCUMENTS

Figure 1A:
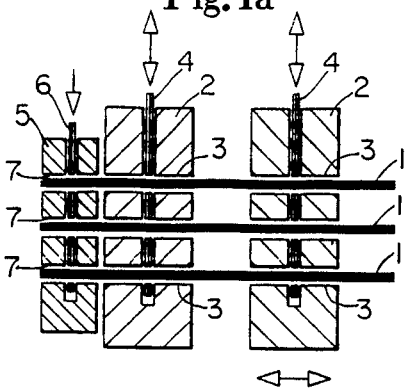
Figure 1B:
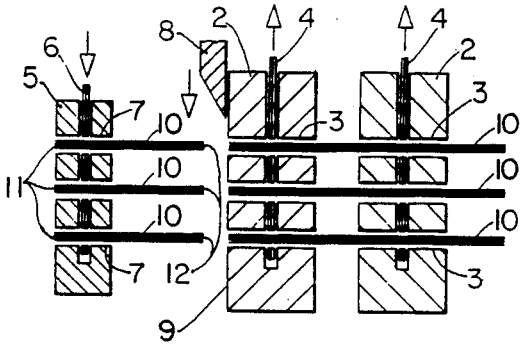
Figure 1C:
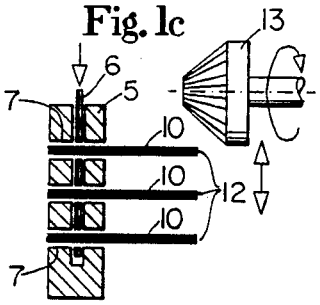
Figure 1D:
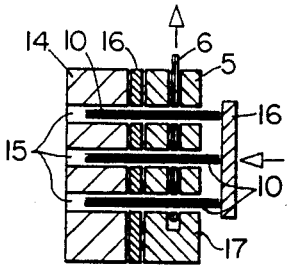
Figure 1E:
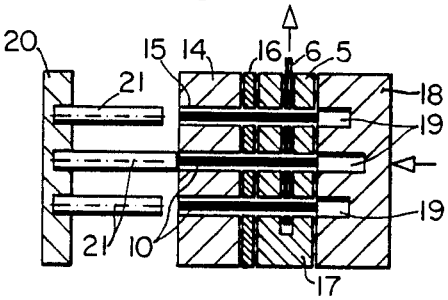
Figure 1F:
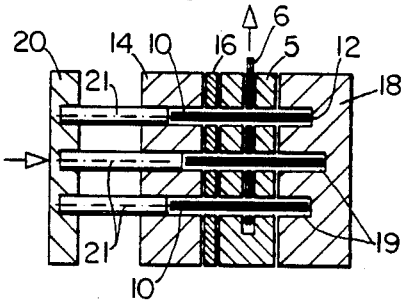

| | | |
|---|---|---|
| 3,641,610 | 2/1972 | Lewis, Jr. . |
| 3,774,782 | 11/1973 | Lewis, Jr. . |
| 3,798,699 | 3/1974 | Lewis, Jr. . |
| 3,799,616 | 3/1974 | Lewis, Jr. . |
| 3,910,637 | 10/1975 | Lewis, Jr. . |
| 3,926,475 | 12/1975 | McCaffray, Jr. . |
| 4,009,910 | 3/1977 | Lewis, Jr. . |
| 4,010,509 | 3/1977 | Huish . |
| 4,109,965 | 8/1978 | Lewis, Jr. . |
| 4,132,449 | 1/1979 | Bergman . |
| 4,189,189 | 2/1980 | Lewis, Jr. . |
| 4,255,224 | 3/1981 | Lorenz . |
| 4,291,431 | 9/1981 | Lewis, Jr. . |
| 4,310,377 | 1/1982 | Lorenz . |
| 4,348,060 | 9/1982 | Lewis, Jr. . |
| 4,355,847 | 10/1982 | Schnekenburger et al. . |
| 4,390,384 | 6/1983 | Turner . |
| 4,472,853 | 9/1984 | Rauch . |
| 4,589,791 | 5/1986 | Weihrauch . |
| 4,607,411 | 8/1986 | Lewis, Jr. . |
| 4,610,045 | 9/1986 | Rauch . |
| 4,619,485 | 10/1986 | Lewis, Jr. . |
| 4,635,313 | 1/1987 | Fassler et al. . |
| 4,637,660 | 1/1987 | Weihrauch . |
| 4,646,381 | 3/1987 | Weihrauch . |
| 4,679,273 | 7/1987 | Okin . |
| 4,690,277 | 9/1987 | Lewis, Jr. . |
| 4,693,519 | 9/1987 | Lewis, Jr. . |
| 4,696,519 | 9/1987 | Lewis, Jr. . |
| 4,749,233 | 6/1988 | Weihrauch . |
| 4,762,373 | 8/1988 | Amos et al. . |
| 4,766,633 | 8/1988 | Clark . |
| 4,776,054 | 10/1988 | Rauch . |
| 4,776,055 | 10/1988 | Nelson . |
| 4,800,608 | 1/1989 | Key . |
| 4,802,255 | 2/1989 | Breuer et al. . |
| 4,807,938 | 2/1989 | Weihrauch ..... 300/21 |

FOREIGN PATENT DOCUMENTS

| | | |
|---|---|---|
| 149996A | 2/1984 | European Pat. Off. . |
| 0142885 | 5/1985 | European Pat. Off. . |
| 024724 | 12/1987 | European Pat. Off. . |
| 0150785 | 4/1989 | European Pat. Off. . |
| 0180491 | 1/1907 | Fed. Rep. of Germany . |
| 845933 | 7/1949 | Fed. Rep. of Germany . |
| 830339 | 2/1952 | Fed. Rep. of Germany . |
| 1049823 | 2/1959 | Fed. Rep. of Germany . |
| 1050304 | 2/1959 | Fed. Rep. of Germany . |
| 1532809 | 4/1970 | Fed. Rep. of Germany . |
| 2335468 | 7/1973 | Fed. Rep. of Germany . |
| 1604673 | 9/1975 | Fed. Rep. of Germany . |
| 2518845 | 11/1976 | Fed. Rep. of Germany . |
| 2840833 | 4/1980 | Fed. Rep. of Germany . |
| 2922877 | 12/1980 | Fed. Rep. of Germany . |
| 8427132 | 4/1985 | Fed. Rep. of Germany . |
| 3433763 | 2/1986 | Fed. Rep. of Germany . |
| 3505972 | 8/1986 | Fed. Rep. of Germany . |
| 24783 | 8/1951 | Finland . |
| 695325 | 12/1930 | France . |
| 794580 | 2/1936 | France . |
| 1057279 | 3/1954 | France . |
| 1467935 | 2/1967 | France . |
| 705725 | 3/1954 | United Kingdom . |
| 2035076 | 6/1980 | United Kingdom . |

PROCESS AND APPARATUS FOR PRODUCTION OF BRISTLE PRODUCTS

The invention concerns a process for the production of bristle products from plastic with bristles whose utilization-side ends are machined rotation-symmetrically, e.g. rounded, and lie in a contour deviating from the bristle-side surface of the bristle carrier and are fastened on their opposite ends to a bristle carrier. Furthermore, the invention is directed toward an apparatus for conducting the process.

For many bristle products, especially those which are generally used in the area of body care, toothbrushes, fine hand brushes, cosmetic brushes or the like, and those which serve for fine application of media, such as paint brushes or the like, there exist special requirements for the quality of the bristles and the bristle field. Thus, the utilization-side, free ends of the bristles should have no sharp edges, splinters, or the like, since these lead to skin damage—in the case of toothbrushes, especially to gum damage—or to a non-uniform application. Besides, bristles with sharp-edged and non-uniform utilization ends break off, close up, etc., more rapidly. For these reasons, the utilization-side ends of the bristles should be rounded, so that they form a spherical surface in the ideal case. The necessity of rounding the bristle ends and the problems appearing with this are described extensively, for example, in U.S. Pat. No. 2,227,126.

For many bristle products, it is furthermore desired to contour the face area of the bristle ends, in order to attain either a desired local cleaning action, as is the case, for example, for toothbrushes, or to gain a smooth application upon moving the device back and forth, for which shaving brushes, artists' brushes, or the like can be named as examples. For this, one can either give the free end of a bristle bundle a certain contour, or else contour all the bristles of a bristle field. For certain brushes, especially bristle brushes, both a contouring of the individual bristle bundles and also of the entire bristle field can be desirable. Also the problem of contouring is depicted, for example, in U.S. Pat. No. 2,227,126.

The rounding of the utilization-side ends of the bristles takes place at the present generally through a type of grinding procedure on the finished brush (U.S. Pat. No. 2,227,126), whereby the guiding of the grinding tool and/or the bristles should take place so that all bristles of a bundle or an entire bristle field are grasped and uniformly rounded. In the known cases, this happens through multi-step grinding with shaped polishing tools of different contour. Likewise, the contouring of single bristle bundles of the entire bristle field takes place through expensive shaped grinding tools and a guiding of the brush that is not much less expensive. Instead of the use of shaped grinding tools for rounding the bristle ends, there is also known a disk-shaped or cone-shaped grinding tool, which travels over the bristle field in different movement directions, optionally even with a tumbler motion. A uniform rounding of the bristle ends can be attained in this way only when the bristle ends are precisely aligned in a plane and also all bristles are aligned parallel to one another. The first requirement is attempted to be fulfilled by cutting the free-standing ends of the bristles fastened to the bristle carrier with rotating knives. Even with this, however, there remain length differences and also oblique cuts occur. A parallel positioning of all bristles can frequently not be accomplished, because, for application reasons, bristles that are positioned at an angle, e.g., V-shaped, are desirable. Both conditions lead to the fact that the bristles have no rotation-symmetric shaped ends, but flat grindings, oblique grindings, or the like.

It is also known (DE-A No. 830,339), to hold single tufts of bristles in a clamping device and grind the ends, which are incidentally of different length, conically by a shaped grinding tool. Contouring the utilization-side ends after grinding is not provided. Also, there is no description of how the tufts are treated afterwards, especially how they are fixed to the bristle carrier.

For contouring and rounding of a bristle field, e.g., on toothbrushes, it is also known (EP-OS No. 0,078,569), to machine the free bristle ends mechanically by cutting tools, whereby the bristles that are not to be machined are bent out from the path of circulation of the cutting tool. This process is expensive and makes possible only the production of simple concave contours with bristles that are longer in the outer rows than in the inner region.

For rounding of the utilization-side ends of the bristles and for contouring single bundles or the entire bristle field, there is also known a thermal process (U.S. Pat. No. 2,426,328). In this, the individual bristles are melted and rounded on their ends through contact with a heated surface. For this, however, in the case of plastic bristles there result thickenings, which are frequently undesirable. These thickenings should be removed according to known processes, but then again no problem-free, spherical bristle end can be obtained. In similar manner, individual bristle bundles are to be contoured by pressing them onto corresponding contoured, heated tools. Here too the formation of a defined contour is largely left to chance and the problem of the formation of thickenings, etc., is still not solved.

None of the known processes for rotation-symmetric machining, especially for rounding the bristle ends, leads to a satisfactory quality. Extensive electron microscopic investigations on the toothbrushes most widely distributed on the market have shown this ("Zahnaerztliche Mitteilungen" 1987, Vol. 16, pages 1740 to 1745; "Quintessence International" 1988, Vol. 2, pages 87 to 107).

The mere contouring of single bristle bundles has proved necessary even in a very early stage of brush technology for shaving brushes and artists' brushes. In a known process technique (U.S. Pat. Nos. 392,420 and 1,923,884) the bristle bundle is pushed, with its fastening-side ends in advance, onto a shaped surface, whose contour corresponds to the desired contour on the utilization-side ends. The last-mentioned contour results from the fact that the bristles within the bundle are displaced axially with respect to one another corresponding to the contour of the shaped surface. In a similar process, the bristle bundle, with its utilization-side end in advance, is pushed into a negative form corresponding to the desired contour (U.S. Pat. Nos. 764,898 and 2,664,316). Then the bristle bundle, contoured on the utilization-side end, is connected on the opposite end with the bristle carrier, which can take place through gluing (U.S. Pat. No. 764,898) or through thermal melting of the bristle ends (U.S. Pat. No. 2,664,316). In the latter case, a largely mechanized process course is possible through the fact that the bristle bundle is placed in a feed canal, which is closed on its end by a negative form corresponding to the desired contour. The bristle bundle, fed tightly into the feed canal, is displaced in the negative form with a piston whose effective piston surface again has the positive form of the later contouring. A similar process is also known for a toothbrush (U.S. Pat. No. 2,488,873), in which, however, a bundle with the fastening-side ends in advance is displaced on a positive form by means of a piston with a corresponding negative form, which acts on the utilization-side ends of the bristles. With a similar process (EP-OS No. 0,142,885), all the bristles of a bristle field, which are found in the canals of a feed device, are contoured by axial displacement with a push plate acting on their utilization-side ends, said plate having on its upper side negative contours for each feed canal. Here, however, the exactness of contouring depends very decisively and uncontrollably on the friction forces within the feed canal and between the bristles.

The invention is directed to the production of bristle products, in which both the bristles are rounded on their utilization-side ends and also all of the bristle ends lie in a face area, deviating from a flat plane, by which either the face area of a single bristle bundle and/or the face area of an entire bristle field is meant. For the combined rounding and contouring, previously either only expensive shaped grinding processes (U.S. Pat. No. 2,227,126) or thermal processes (U.S. Pat. No. 2,426,328) are known.

The invention has as a basis the problem of making possible a trouble-free rounding of the bristle ends with constant and reproducible quality as well as making possible a contouring of single bristle bundles or the entire bristle field, in which the bristle ends are rounded.

The problem is solved according to the invention, in regard to the technical process, by clamping the bristles with their utilization-side ends in a flat plane lying at a distance from this, and machining them on their utilization-side ends mechanically or chemically, then detaching the clamps, after that contouring them by axial displacement and finally fastening them with the opposite ends on the bristle carrier.

In a departure from most of the known processes, for the present invention the utilization-side ends of the bristles are machined before the bristles are fastened onto the bristle carrier in order to attain a rotation-symmetrical shaping of the utilization-side ends of the bristles. Thus, all quality-reducing influences, which result from a prior fastening of the bristles to the bristle carrier because of manufacturing tolerances (bristle length) and bristle position, are eliminated.

For the process according to the invention, the bristles, which can be processed in the form of short cuts or of endless strands, are prepared so that their utilization-side ends are found on a flat face area. In this state, the bristles are clamped at a distance from their utilization-side ends and then machined on these ends, especially rounded. This can happen in conventional manner through grinding, but also through a chemical etching process or the like. Through the fact that all the bristles lie in a plane, the utilization-side ends can be rounded without problem and uniformly.

After machining their utilization-side ends the bristles are detached from the clamps and axially displaced to create an arbitrary contour of the utilization-side ends. Not until the rounding and contouring is done are the bristles fixed to the bristle carrier.

Of special importance in the process according to the invention is the fact that before the machining the bristle ends lie on a plane face area. This can be attained through pushing the bristles with these ends on a plane surface, but it is preferably provided that the bristles are clamped, cut flat at a distance from the clamping for formation of the utilization-side ends and then machined on these ends. Thus it is assured that, for each individual bristle, absolutely the same conditions are present during the machining.

Contouring the bristles after they are loosened from the clamping can be effected for instance by axial displacement against a negative form to obtain the desired contour. Next the bristles can be fastened to the bristle carrier on their opposite ends with the help of one of the known technologies. With this process, the quality of the rounded ends remains completely maintained during the contouring, so that a contoured bristle field, optionally also only contoured individual bundles or else a combined contouring of bundles and bristle field, is attained in any shaping of the effective surface.

Thus, according to a variation of the process according to the invention, it can especially be provided that all the bristles forming the bristle field of a bristle product are clamped at a distance from their utilization-side ends lying in a flat plane, their utilization-side ends are machined mechanically or chemically, then loosened from the clamping and finally contoured against the negative form.

In this manner, the entire bristle field can be rounded in one procedure, and then be contoured and last be fastened to the bristle carrier according to one of the known processes, e.g., welding, seaming, gluing, injecting or foaming in.

For the case that the bristle product to be produced consists of a large number of bristles gathered into multifilament groups, e.g., bundles, strips, or packets, according to a preferred form of execution, it can be provided that the groups of bristles, after machining of the utilization-side ends and loosening from the clamping, can be contoured individually or group-wise with their utilization-side ends against the negative form.

In this way, within a bristle field, a single or several bundles, strips or packets can have a greater length or height. It is also possible to combine round bristle bundles with narrow bristle strips or with bristle packets within a field and to contour differently, so that a large number of cleaning possibilities are present and an optimum adaptation to a certain cleaning task is possible.

The process according to the invention can be conducted both for so-called short cuts, which are bristles, paint brushes, or the like, cut approximately to usage length, and also for processing of endless strands. For the latter type of processing, the endless strand is supplied to the processing station in cycles corresponding to the bristle length to be processed in each work cycle. In this manner of processing, the process according to the invention can be carried out in an especially advantageous manner by clamping the bristles at the front-running end of the endless strand, cutting at a distance from this end of the endless strand, with formation of the utilization-side ends, machining these ends mechanically or chemically, after loosening from the clamping, contouring against the negative form counter to the supply device of the endless strand, clamping at a distance from the opposite ends and cutting these, forming the fastening-side ends.

A short cut is thus formed from the endless strand in customary manner, whereby the front-running end forms the fastening ends of the bristles or bundles, while the end resulting through cutting at the processing station forms the utilization-side ends. These are then rounded mechanically or chemically and contoured against the negative form through movement counter to the supply direction of the endless strand. Because of the contouring, the fastening-side ends are found on a face area, which deviates from a flat plane, so that the bristles on these ends are advantageously cut back in a common plane, in order then to fasten them in the bristle carrier in conventional manner.

Thus it preferably proceeds so that the bristles or bristle units, after cutting on the fastening-side ends, are loosened from the clamping, displaced with these ends in advance into a position in which they are fastened to the bristle carrier, and again clamped.

Through the previously mentioned measures, there is attained a uniform projection for all bristles on the fastening-side ends, where the clamping is also effective during the fastening phase, so that this clamping fulfils a multiple purpose, namely, on the one hand, the fixing of the bristles in the cutting from the endless strand, in the subsequent preparing or rounding of the utilization-side ends, in the cutting of the bristles on the fastening-side ends and finally during the fastening phase.

In known apparatus for producing bristle products comprising a bristle carrier and bristles whose utilization-side ends are machined rotation-symmetrically, e.g., rounded, and are located in a contour differing from the fastening-side surface of the bristle carrier (e.g., U.S. Pat. No. 2,227,126), the utilization-side ends of the bristles are moved over the grinding tools after they have been trimmed to the desired contour.

By the way of contrast, an apparatus constructed according to the present invention is characterized in that a clamping device is provided, by means of which the bristles can be clamped at the machining station singly or in groups at a distance from their utilization-side ends lying in a flat plane and can be brought at first into the work location with the machining device and, after loosening the clamping followed by axial displacement of the bristles against each other, into the work location with the fastening device.

In a preferred form of execution, it is provided that the clamping device is located at a distance from a cutting device, by means of which the bristles can be cut flat for forming the utilization-side ends.

Preferably the invention proceeds from known apparatus which consists of a device for feeding the bristles tightly into a canal, a piston acting on the fastening-side ends of the bristles and capable of being displaced into the canal, a negative form corresponding to the contour of the bristles on their utilization-side ends, attached to the feed device, and into which the bristles are displaced by means of the piston, and a device for fastening the bristles on the bristle carrier after drawing back the piston. Apparatus of this type are described, for example, in the U.S. Pat. Nos. 2,488,873 and 2,664,316 named at the start.

An apparatus of the previously named type is characterized, according to the invention, in that there is attached to the feed device a clamping device, by means of which the bristles can be clamped at a distance from their utilization-side ends and are secured in the axial direction, and a device for mechanically or chemically machining, e.g., rounding, with which the bristles, with their utilization-side ends, can be brought into working connection, and in that, after loosening the clamping device, the piston can be driven into the canal in order to displace the bristles against the negative form.

If the bristle field consists of a large number of bristle bundles, strips or packets, and if this field is not in itself contoured, but only the individual bristle groups among one another, then each bristle group is associated with a piston with a plane push surface, whose cross section—and also the cross section of the feed canal—corresponds to that of the bristle group. If, on the other hand, the bristle groups are in themselves to be contoured simultaneously, then the piston can have a correspondingly contoured push surface, e.g., similar to a reducing piston. After the rounding and contouring, the bristle groups can be fastened to the bristle carrier, not only in the parallel position, but also in any angle position. It is always guaranteed that the contour is maintained and uniformly rounded bristle ends lie within each contour.

The different projection of individual bristles or bristle groups within a bristle field, which is produced by displacement by means of the piston, can be accomplished either through different stroke paths of the pistons or else through the fact that all pistons sit on a common carrier and have correspondingly different lengths.

If the bristles or bristle groups are processed from an endless strand and fed in cycles by means of a feed device, then the apparatus according to the invention is constructed so that the clamping device, with a number of canals corresponding to the number of endless strands, is located in alignment with the feed device, and that, after the introduction of the front-running ends of the endless strands into the canals, the clamping device can be closed and that, in the feed direction, before the clamping device, there is located a cutting device for cutting to length the bristles from the endless strand and for formation of the utilization-side bristle ends, whereby the device for rounding the utilization-side ends can be placed before this and the clamping device. It is especially advantageous for an optimum rounding that the bristle ends be exactly flush in a plane face area, attained through the simultaneous cutting of the individual clamped bristle strands in a flat plane.

With this construction of the apparatus, bristles can be cut from endless strands in cycles in a single work station and finished on their utilization-side ends. Instead of this, the individual work steps, such as cutting and finishing, as well as the subsequent procedures, can also be conducted in a closed motion path with individual machining stations, in order to obtain shorter cycle times in this manner.

According to a further advantageous example of execution, it is provided that the feed device is located in the supply direction of the bristles behind the clamping device and behind this, a carrier with the pistons and that, before the clamping device, there is located a pushing device acting on the machined bristle ends, by means of which the bristles can be pushed into the canals of the feed device far enough that the utilization-side ends stop flush on the side of the clamping device near them.

With this construction, it is assured that the utilization-side ends, after finishing, move into a common plane corresponding to the plane of the pushing device and upon subsequent placing of the pistons, the bristles or bristle groups travel the exact path for their contouring. This is possible then, for example, when the negative form can be placed before the side of the clamping device and then the pistons on the carrier can be brought into the canals of the feed device.

Finally, it can be provided that, on the side of the clamping device turned away from the negative form, there is arranged a cutting device, which cuts the ends of the bristles projecting beyond this side, after the moving away of the feed device, with formation of the fastening-side ends. With the cutting device, the ends projecting because of the contouring are cut so that the resulting fastening-side ends lie in a flat plane.

In as much as the entire machining occurs at one station, the cutting device for cutting to length the bristles from the endless strand can also form the cutting device for cutting off the ends projecting beyond the side of the clamping device.

In order to obtain on the fastening-side ends, a uniform projection of all bristles or bristle groups necessary for fastening, it is preferably provided that the cut bristles can be displaced, by means of the negative form, with an open clamping device, so far into this until their fastening-side ends, lying in a flat plane, project beyond the side of the clamping device, turned away from the negative form, with a length necessary for their fastening onto the bristle carrier.

The negative form thus also serves as a pushing element for displacing the bristles into a fastening position. Thus, the contouring imparted previously to the bristles remains held exactly.

Finally, the clamping device can serve for axial securing of the bristles during the fastening of the bristles to the bristle carrier, so that it fulfills a multiple function. If the individual work processes take place in different work stations, then the clamping device moves along with the bristles and changes from work station to work station. With this manner of work, then a number of clamping devices corresponding to the number of work stations must be present.

Figure 3:
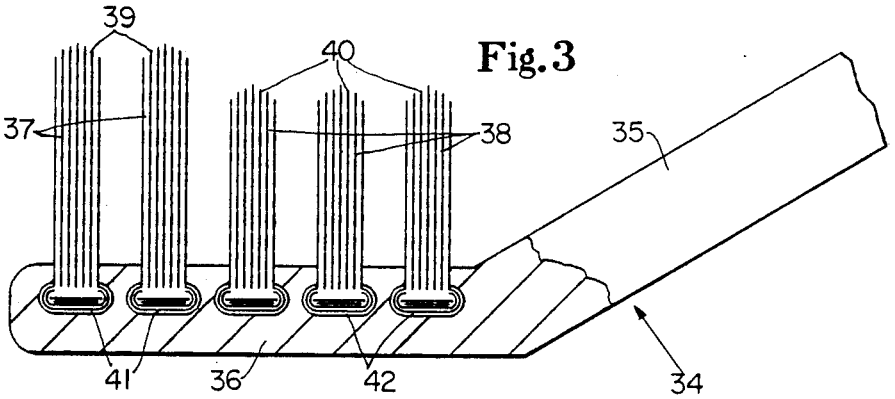

Below, on is described by means of an example of execution reproduced in the drawing. In the drawing:

FIGS. *1a–1i* shows a schematic view of the components of an apparatus essential for the conducting, in the various stages of a process for the production brush;

FIGS. *2a–2e* shows different process stages in the production of contoured bristle groups, e.g., bristle bundles;

FIG. 3 an example of execution in the form of a toothbrush in section, and

Figure 4:
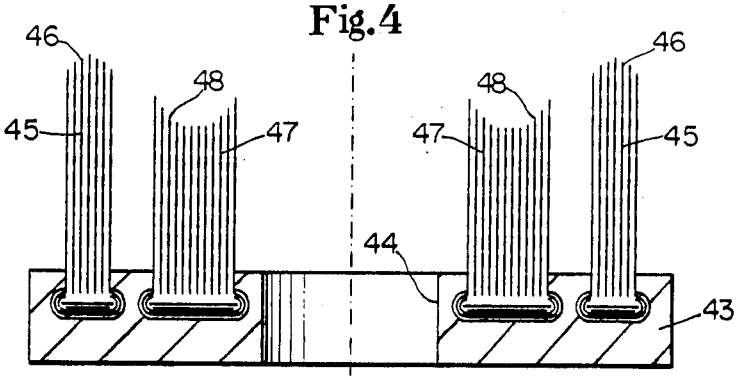

FIG. 4 an example of execution of a round brush in section.

In FIG. *1a* and FIG. *1b*, the processing of the bristles from an endless strand is shown schematically. For this, three endless strands 1 are shown, which are supplied from spools by means of a feed device. To this feed device belong two tension devices 2, located one behind the other, which have feed canals 3 for the endless strands 1 and each of which has a slide 4, which, like a shutter, constricts the cross section of the canals 3 and in this way fixes the endless strand 1. The first tension device 2 (in the drawing reproduced on the right) can optionally be moved back and forth in the feed direction and can displace the endless strand 1 in cycles by holding it and then moving in the feed direction with a simultaneously open second tension device 2. The drawing-off can also take place, however, by means of a clamping device 5 located behind the second tension device 2, which also has a slide 6, acting like a shutter, by means of which the canals 7 provided in the clamping device 5 can be constricted. In FIG. *1a* and *1b*, the latter execution is represented.

After the introduction of the endless strands 1 into the canals 7 of the clamping device 5, the slide 6 is moved into the closed position, so that the endless strands 1 are clamped on their front-running ends. Next, the clamping device 5, as evident from the comparison of FIGS. *1a* and *1b*, is displaced to the left by approximately the necessary bristle length. Next a cutting device 8 moves before the side 9 of the front tension device 2 and separates the individual bundles 10 from the endless strands 1. The ends 11 of the bundles 10, later serving for fastening, are closed off somewhat with the front side of the clamping device 5, while the utilization-side ends 12 remain free.

In the next process step, according to FIG. *1c*, before the utilization-side ends 12, there is introduced a conical grinding tool 13, which grinds the utilization-side ends in a translational and a rotational movement. Optionally, a movement lying perpendicular to the plane of the drawing or a tumbling movement can also be used.

After the finishing of the utilization-side ends 12 of the bristle bundles 10, before the clamping device 5, there is introduced a feed device 14 (FIG. *1d*), which has a number of aligned feed canals 15 corresponding to the canals 7 in the clamping device. Between the clamping device 5 and the feed device 14, there is introduced, optionally, a cutting plate 16, whose purpose is explained later. Through lifting the slide 6, the bristle bundles 10 are released in the clamping device 5. On the utilization-side ends 12 of the bristle bundles 10, then, there acts a pushing device 16 in the form of a plate, which displaces the bristle bundle 10 in the feed canals 15 of the feed device 14, until they stop with the utilization-side ends 12 flush with the rear side 17 of the clamping device 5.

After moving forth the pushing device 16, before the rear side 17 of the clamping device 5, there is placed a negative form 18 (FIG. *1e*), which has a pocket hole 19 for each bristle bundle, whereby the pocket holes 19 align with the canals 7 in the clamping device 5 and the canals 15 in the feed device 14. The pocket holes 19 have different depths. The bottoms of the pocket holes form the later contour of the bristle bundles on the finished bristle product.

On the opposite side of the clamping device 5 and the feed device 14 is located a carrier 20 with a number of pistons 21 corresponding to the number of feed canals 15, and these pistons 21 differ from one another in their length in the same manner as the pocket holes 19 differ in their depth.

The carrier 20 with the pistons 21 is moved toward the feed device 14, so that the pistons 21 penetrate into the feed canals 15 and displace the bristles 10 found therein far enough until they strike on the bottom of the pocket holes 19, so that the utilization-side ends 12 of the bristle bundles 10 lie in the desired contour, as is shown in FIG. *1f*.

Then the carrier 20, with the pistons 21, and the feed device 14 move away (in FIG. *1g* toward the left), so that the bristle bundles 10, with their opposite ends, project beyond the clamping device 5 of the cutting plate 16 located before it, and are cut flush by means of a cutting knife 22 passed before the cutting plate 16, so that they lie in a common plane (FIG. *1h*).

Figure 1G:
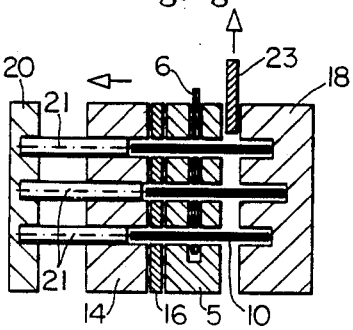

In order to be able to determine the final length of the bristles or to be able to realize different bristle lengths, in addition, a spacer plate 23 can be provided, which can be placed between the clamping device 5 and the negative form 18. For this purpose, the bristle bundles 10, with an open clamping device 5, are displaced in the direction of their utilization-side ends 12, by synchronously displacing the carrier 20 with the pistons 21 and the negative form 18, (in FIG. 1g to the right), with the clamping device 5 and feed device 14 remaining stationary. In this way, there results, between the clamping device 5 and the negative form 18, a split, in which the spacer plate 23 is placed. This has openings, e.g., slits or the like, which are penetrated by the bristle bundles 10. After renewed clamping of the bristle bundle 10 by means of the slide 6 in the clamping device 5, the cutting to length by the cutting knife 22 takes place.

Figure 1H:
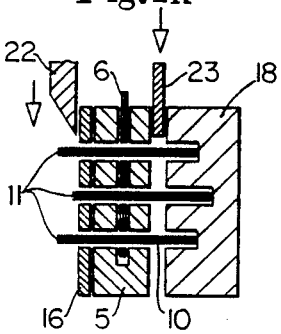
Figure 1I:
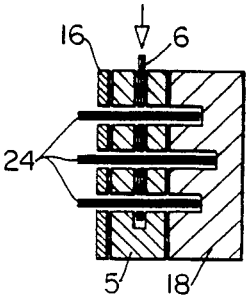

Then the spacer plate 23 moves out between the clamping device 5 and the negative form 19 (FIG. 1h) and the negative form 19 moves in the direction of the clamping device 5, until it strikes on this, so that the bristle bundles 10, with their fastening-side ends 24, project beyond the cutting plate 16 with the same length (FIG. 1i). In this position, the ends 24 are connected with the bristle carrier in a manner known in itself and no longer shown.

Figure 2A:
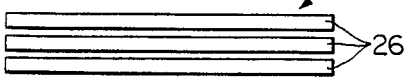
Figure 2B:
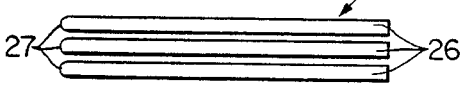
Figure 2C:
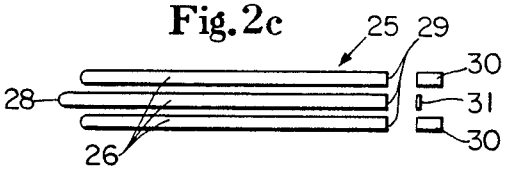

In FIGS. 2a to 2e is shown a single bristle bundle 25 by means of three individual bristles 26 lying in the plane of the drawing. The pre-cut bristles 26, gathered into a bundle 25 (FIG. 2a) are first clamped and finished on their ends 27 by rounding (FIG. 2b). Next the individual bristles 26 are contoured by displacing them by means of a contoured piston in a feed canal against a negative form, so that, for example, the middle bristle 26 or a large number of bristles in the middle region of the bundle 25 project beyond the remaining bristles with their ends 28 (FIG. 2c). With the dotted line in FIG. 2c, there is indicated the cut for producing the fastening-side ends 29, and with 30, 31, the different length cuts, which fall off upon cutting to length.

Figure 2D:
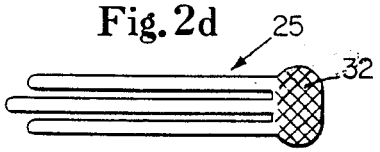
Figure 2E:
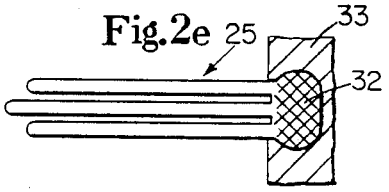

After the contouring, the position of the bristles 26 within the bundle 25 can be fixed, in such a way that the bristles 26, on their fastening-side ends, are melted to a thickening 32 (FIG. 2d). This thickening 29 can then serve for fastening within the bristle carrier 33 in a subsequent work step, for example, through injecting, foaming in or rabbeting (FIG. 2e).

In FIG. 3, the process according to the invention is shown by means of a finished bristle product in the form of a toothbrush 34, whose back 36, in one piece with the handle 35, consists of plastic. It has bristle bundles 37 and 38 of different lengths, whose utilization-side ends 39 or 40 lie in a contoured face area and which are contoured in turn. The bristle bundles 37 and 38—similar as described for FIGS. 2d and 2e—can be anchored in the back 36 of the toothbrush 34 by means of thickenings 41 or 42.

FIG. 4 shows a round brush 43, as is, for example, also used for dental care, and which is mounted on a drive shaft that is not shown, by means of an axial bearing 44. The round brush 43 has an outer bristle crown of bundles 45, which are contoured convex on their utilization-side ends 46. Furthermore, the round brush 43 has an inner bristle crown of bundles 47, which are contoured concave on their utilization-side ends 48.

All of the features represented in the description, the claims and the drawings can be employed in practicing the present invention, either alone or in any combination with one another or in another sequence.

What is claimed is:

1. A process for the production of bristle products from plastic, said products comprising a bristle carrier and bristles whose utilization-side ends are substantially uniformly rounded and located in a contour differing from that of the bristle-side surface of said bristle carrier and whose opposite ends are fastened to said bristle-side surface of said bristle carrier, said process comprising the steps of: clamping said bristles while their utilization-side ends are in a flat plane; substantially uniformly rounding the utilization-side ends of said bristles while they are clamped in said flat plane; loosening the clamp restraining said bristles and thereafter axially displacing the utilization-side ends of said bristles relative to one another to produce said contour; and fastening the opposite ends of said bristles to said bristle carrier.

2. The process of claim 1, wherein said utilization-side ends of said bristles are substantially uniformly rounded by mechanically machining said utilization-side ends while they are in said flat plane.

3. The process of claim 1, wherein said utilization-side ends of said bristles are substantially uniformly rounded by chemically treating said utilization-side ends while they are in said flat plane.

4. The process of claim 2 or claim 3, wherein said bristles are clamped, cut flat at a predetermined distance from where they are clamped to produce utilization-side ends of said bristles all in said flat plane, and thereafter substantially uniformly rounded on these ends while they are in said flat plane.

5. The process of claim 4, wherein said bristles are unclamped after their utilization-side ends have been substantially uniformly rounded while in said flat plane and are thereafter contoured by axial displacement of said bristles against a negative form corresponding to said contour prior to fastening the opposite ends of said bristles to said bristle carrier.

6. The process of claim 5, wherein said opposite ends of said bristles are cut in a flat plane prior to fastening them to said bristle carrier.

7. The process of claim 6, wherein said opposite ends of said bristles are melted to form a thickening after they are cut in a flat plane and wherein said thickening is thereafter fastened to said bristle carrier.

8. The process of claim 7, wherein said thickening is fastened to said bristle carrier by enclosing said thickening within the material comprising said bristle carrier.

9. A process for the production of bristle products from plastic, said products comprising a bristle carrier and bristles whose utilization-side ends are uniformly rounded and lie in a contour deviating from the bristle-side surface of the bristle carrier, said process comprising the steps of: clamping said bristles while their utilization-side ends are in a flat plane located a predetermined distance from the means used to clamp said bristles; substantially uniformly rounding the utilization-side ends of said bristles while they are maintained in said flat plane; contouring the utilization-side ends of said bristles by axial displacement of said bristles after they are unclamped by means of a negative form corresponding to said contour; and finally fastening the opposite ends of said bristles to said bristle carrier.

10. The process of claim 9, wherein said opposite ends of said bristles are cut in a flat plane prior to fastening them to said bristle carrier.

11. The process of claim 10, wherein said opposite ends of said bristles are melted to form a thickening after they are cut in a flat plane and wherein said thickening is thereafter fastened to said bristle carrier.

12. The process of claim 11, wherein said thickening is fastened to said bristle carrier by enclosing said thickening within the material comprising said bristle carrier.

13. The process of claim 9, wherein the utilization-side ends of said bristles are substantially uniformly rounded by mechanically machining said utilization-side ends while they are in said flat plane.

14. The process of claim 9, wherein said utilization-side ends of said bristles are substantially uniformly rounded by chemically treating said utilization-side ends while they are in said flat plane.

15. The process of claim 9, wherein said bristles are gathered into multifilament groups comprising one or more bundles, strips or packets prior to having their utilization-side ends substantially uniformly rounded, and wherein said bundles, strips or packets are contoured alone or in groups with their utilization-side ends against said negative form exhibiting said contour after the utilization-side ends of the bristles in said bundles, strips or packets have been substantially uniformly rounded and said bristles have been unclamped.

16. The process of claim 15 characterized in that said bristles, with their utilization-side ends in advance, are pressed against said negative form with axial displacement by pushing said bristles from their opposite ends.

17. The process of claim 1, claim 9, or claim 15, wherein said bristles or bristle groups are processed from an endless strand that is supplied in cycles; said bristles are clamped on the front-running end of the endless strand; cut off at a predetermined distance from this end of the endless strand to produce utilization-side ends in a flat plane; said utilization-side ends are substantially uniformly rounded while in said flat plane, said utilization-side ends of said bristles are contoured against a negative form exhibiting said contour after loosening of said clamping; said bristles are again clamped at a predetermined distance from their opposite ends and cut at this end to produce fastening-side ends in a flat plane prior to fastening said bristles to said bristle carrier.

18. The process of claim 17, wherein said bristles or bristle groups are loosened from the clamping after the cutting to produce their fastening-side ends, and, with these ends in advance, are moved into a position in which they are fastened on the bristle carrier and again clamped.

19. Apparatus for the production of bristle products from plastic, said bristle products comprising a bristle carrier and bristles whose utilization-side ends are substantially uniformly rounded and located in a contour differing from that of the fastening-side surface of said bristle carrier, said apparatus comprising: a holder for positioning said bristles at a machining station, said holder including clamping means by which said bristles, alone or in groups, can be clamped at said machining station at a predetermined distance from their utilization-side ends which lie in a flat plane; grinding means at said machining station for rounding the utilization-side ends of said bristles; means for fastening the opposite ends of said bristles to said bristle carrier; means for bringing said holder into the work location with said machining station; and means for bringing said holder into the work location with said fastening means after loosening said clamping means and axially displacing said bristles to form said contour at their utilization-side ends.

20. The apparatus of claim 19, wherein said clamping means is mounted a predetermined distance from a cutting means for cutting said bristles to produce utilization-side ends in a flat plane.

21. The apparatus of claim 19, said apparatus further including means for feeding said bristles tightly into a canal; a piston which is movable into and out of said canal for acting upon the fastening-side ends of said bristles; a negative form corresponding to the contour of said bristles at their utilization-side ends attached to said feeding device, whereby said bristles are displaced by means of said piston until their utilization-side ends encounter said negative form; and means for fastening said bristles to said bristle carrier after withdrawal of said piston from said canal.

22. The apparatus of claim 21, wherein said means for feeding said bristles has a multiplicity of said feed canals, each for receiving a group of said bristles, and wherein a piston is provided for each feed canal, said pistons having different lengths, corresponding to the different displacement paths of said bristle groups until they contact said negative form.

23. The apparatus of claim 22 including cutting means for cutting the fastening-side ends of said bristles in a flat plane after said utilization-side ends of said bristles have assumed the contour of said negative form.

24. The apparatus of claim 22, wherein said bristle groups are received by said feeding means in cycles in the form of endless strands and wherein the number of said feed canals corresponds to the number of said endless strands.

25. The apparatus of claim 24, said apparatus further including cutting means for cutting to length said bristles from said endless strands.

26. The apparatus of claim 19, wherein said grinding means for machining the utilization-side ends of said bristles is positioned in front of said clamping means.

* * * * *

UNITED STATES PATENT AND TRADEMARK OFFICE

CERTIFICATE OF CORRECTION

PATENT NO. : 4,979,782

DATED : December 25, 1990

INVENTOR(S) : Georg Weihrauch

It is certified that error appears in the above-identified patent and that said Letters Patent is hereby corrected as shown below:

On the title page:
In the ABSTRACT, line 4, "unformly" should read -- uniformly -- .

Page 2, under Foreign Patent Documents, "024724" should read -- 0247224 -- .

Column 7, line 36, delete "on" and insert therefor -- the invention -- .

Column 7, line 45, after "Fig. 3" insert -- shows -- .

Column 7, line 47, after "Fig. 4" insert -- shows -- .

Claim 19, line 47, after "and" insert -- are -- .

Signed and Sealed this

Ninth Day of June, 1992

*Attest:*

DOUGLAS B. COMER

*Attesting Officer*

*Acting Commissioner of Patents and Trademarks*